US006186847B1

(12) United States Patent
Ketterman et al.

(10) Patent No.: US 6,186,847 B1
(45) Date of Patent: Feb. 13, 2001

(54) PAINTER LINE ASSEMBLY

(75) Inventors: Kenneth L. Ketterman, Hampton; Raymond M. Kinne, Newport News, both of VA (US)

(73) Assignee: Hampton Rubber Co., Hampton, VA (US)

( * ) Notice: Under 35 U.S.C. 154(b), the term of this patent shall be extended for 0 days.

(21) Appl. No.: 09/361,229

(22) Filed: Jul. 27, 1999

(51) Int. Cl.[7] ..... B63L 9/22
(52) U.S. Cl. ..... 441/42; 242/170; 441/84
(58) Field of Search ..... 242/170, 172, 242/159; 441/80–85, 35, 42

(56) References Cited

U.S. PATENT DOCUMENTS 2,959,278 * 11/1960 Mitchell et al. ..... 206/46
5,154,653 10/1992 Ketterman et al. .

* cited by examiner

*Primary Examiner*—Ed Swinehart
(74) *Attorney, Agent, or Firm*—Birch, Stewart, Kolasch & Birch, LLP

(57) ABSTRACT

A bung plug assembly (30), of a type including a tubularly-shaped housing (32) having a grommet cap (34) at one end thereof, also includes a hard-material bulkhead adapter assembly (37). The bulkhead adapter assembly includes a bulkhead adapter (69) with a smooth-surface bulkhead-adapter bore (41) therethrough and a separate bulkhead-adapter nut (80). The bulkhead adapter has a tube portion (70) with left-hand male threads thereon and a radially-outwardly extending flange portion (74). The tube portion is extended through a grommet cap bore (40), until the flange portion abuts on a surface of the grommet cap, for also being extended through an opening (88) in a wall (39) of a life raft canister. The separate bulkhead-adapter nut is for being screwed onto the tube portion for clamping the wall of the life raft canister between the bulkhead-adapter nut and the grommet cap. The bung plug assembly further includes a bung plug (38) having a rope passage (42) therethrough for tightly receiving an end of a rope and for tightly engaging the bulkhead-adapter bore.

12 Claims, 5 Drawing Sheets

PAINTER LINE ASSEMBLY

BACKGROUND OF THE INVENTION

This invention relates broadly to devices for holding coiled rope in life raft canisters for allowing easy pay out thereof in times of emergency.

Some life raft storage systems comprise clamshell canisters designed to hold, for example, sixteen man life rafts with provisions for survival at sea in an event of an emergency. Such life rafts are inflated by compressed-air cylinders which are also encased in the clamshell canisters. Compressed air is released from the cylinders into the rafts when lanyards, that are respectively attached to valves of the cylinders, are pulled. In a prior-art example, such a lanyard is attached to an inner-end portion of a 100 ft. coiled rope bundle, which is also encased in the clamshell canister, with an outer-end portion of the coiled rope being attached to a tie cleat on a boat. When an emergency occurs, for example when a boat on which such a clamshell canister is mounted is sinking, the clamshell canister is thrown overboard along with the enclosed life raft and compressed-air cylinder. Since the outer-end portion of the coiled rope is affixed to the cylinder valve, as the clamshell canister, with life raft and cylinder, fall downwardly, the coiled rope is paid out, or pulled out, of the clamshell canister until the clamshell canister travels 100 feet from the tie cleat to which the outer-end portion of the rope is attached. At this point, the rope is placed under tension, which tension pulls the lanyard, thereby opening the valve on the cylinder to release compressed air to inflate the raft in the clamshell canister. As the raft inflates, it applies outwardly directed force on the clamshell canister, which separates top and bottom halve shells of the clamshell canister, thereby releasing the life raft to be ready for use.

Previous methods of storing coiled rope in such clamshell canisters has often caused "snagging" of the rope during payout thereof. That is, while a coiled rope has been paid out of a falling clamshell canister, it has sometimes, snagged, so that it never applied tension on the inner-end portion of the rope and therefore never activated the cylinder of compressed air.

U.S. Pat. No. 5,154,653 to Ketterman et al. describes a bung plug assembly, or painter line assembly, which allows easy payout of rope from a clamshell canister with reduced possibilities of snagging. The bung plug assembly described in that patent comprises a resilient grommet cap holding a tubularly shaped housing to a canister with coiled rope in the tubularly-shaped housing. The bung plug assemble of that patent pays out rope from a coiled rope winding in the tubularly-shaped housing. There is a resilient rear cap at an opposite end of the tubularly-shaped housing through which an inner-end portion of the rope extends to a lanyard attached to a valve of a compressed-air cylinder. A bung plug through which an outer-end portion of the rope extends is insertable into a grommet-cap bore of the grommet cap, and the grommet cap has radially directed slots in which half shell edges of a clamshell canister engage. A resilient molded key engages a key slot of the grommet cap for resilently contacting the clamshell canister and holding the bung plug assembly in position at the intersection of the half shells on the clamshell canister. Rope is paid out through the grommet-cap bore once the bung plug is pulled out of the grommet-cap bore by tension.

Although the apparatus described in U.S. Pat. No. 5,154,653 has been quite successful, it has had several shortcomings. A main problem with that apparatus has been that it could only be mounted at the interface between the half shells of the clamshell canister. This has proven to be disadvantageous in cases where life rafts are unusually large so that the assemblies do not always conveniently fit into the clamshell canisters at the interfaces of the half shells. Also, it has been disadvantageous where tie cleats and clamshell canisters cannot be conveniently aligned for proper deployment.

Stated another way, bung plug assemblies of the prior art have not provided sufficient mounting-position flexibility. Thus, it is an object of this invention to provide a painter line assembly, or bung plug assembly, which can be mounted at almost any position on a clamshell canister.

Another problem with most bung plug assemblies of the prior art is that unauthorized persons could easily tamper with them. For example, in the case of the assembly of U.S. Pat. No. 5,154,653 one could easily remove the resilient molded key and thereby loosen the mount of the bung plug assembly. Accordingly, it is a further object of this invention to provide a painter line assembly which discourages unauthorized tampering.

Still another difficulty with the prior-art bung plug assembly of U.S. Pat. No. 5,154,653 is that, because it must be mounted at the interface of the half shells, the stability of its mount depends upon the relative positions of the half shells. Similarly, it cannot be mounted on the clamshell canister until the half shells are assembled together. Because of this, the bung plug assembly sometimes interfered with closing the half shells to enclose the life raft. Thus, it is yet another object of this invention to provide a painter line assembly which can be stably mounted on half shells of a life-raft clamshell canister before the half shells are brought together so that it does not unduly interfere with assembly of the half shells.

SUMMARY OF THE INVENTION

According to principles of this invention, a bung plug assembly of a type including a tubularly-shaped housing having a grommet cap at one end thereof, also includes a hard-material bulkhead adapter assembly. The bulkhead adapter assembly includes a bulkhead adapter with a smooth-surface bulkhead-adapter bore therethrough and a separate bulkhead-adapter nut. The bulkhead adapter has a tube portion with male threads thereon and a radially-outwardly extending flange portion. The tube portion is extended through a grommet bore in the grommet cap until the flange portion abuts on a surface of the grommet cap for then also being extended through an opening in a wall of a life raft canister. The separate bulkhead-adapter nut is for being screwed onto the tube portion after it has been extended through the wall of the life raft canister for thereby clamping the wall of the life raft canister between the bulkhead-adapter nut and the grommet cap. The bung plug assembly further includes a bung plug having a rope passage therethrough for tightly receiving an end of a rope in a cavity of the tubularly-shaped housing and for tightly engaging the bulkhead-adapter bore.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of preferred embodiments of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
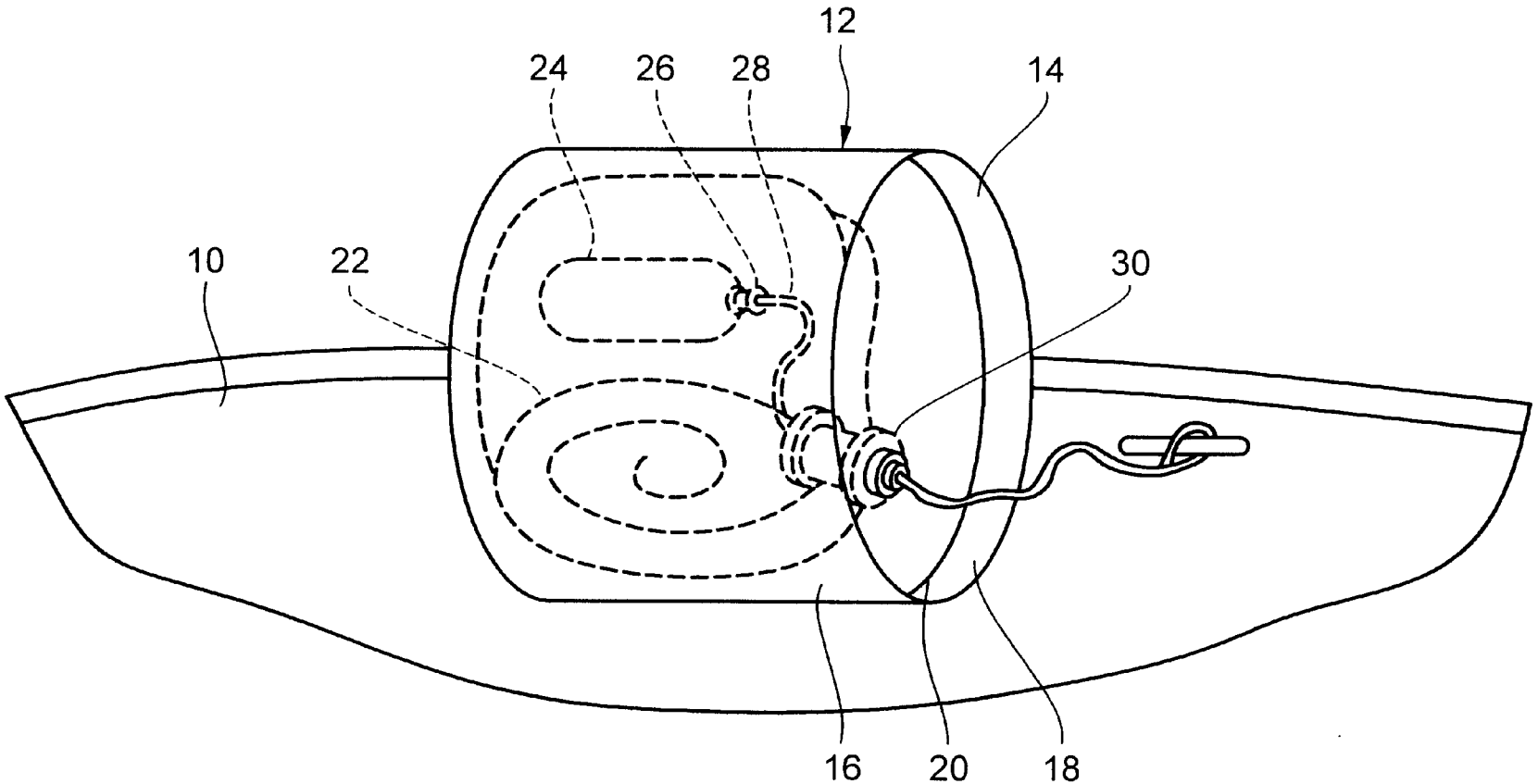
FIG. 1 is an isometric view of a section of a boat, or ship, having a clamshell canister with a bung plug assembly of this invention mounted thereon as well as a life raft, and a compressed-air cylinder mounted in the canister.
Figure 2:
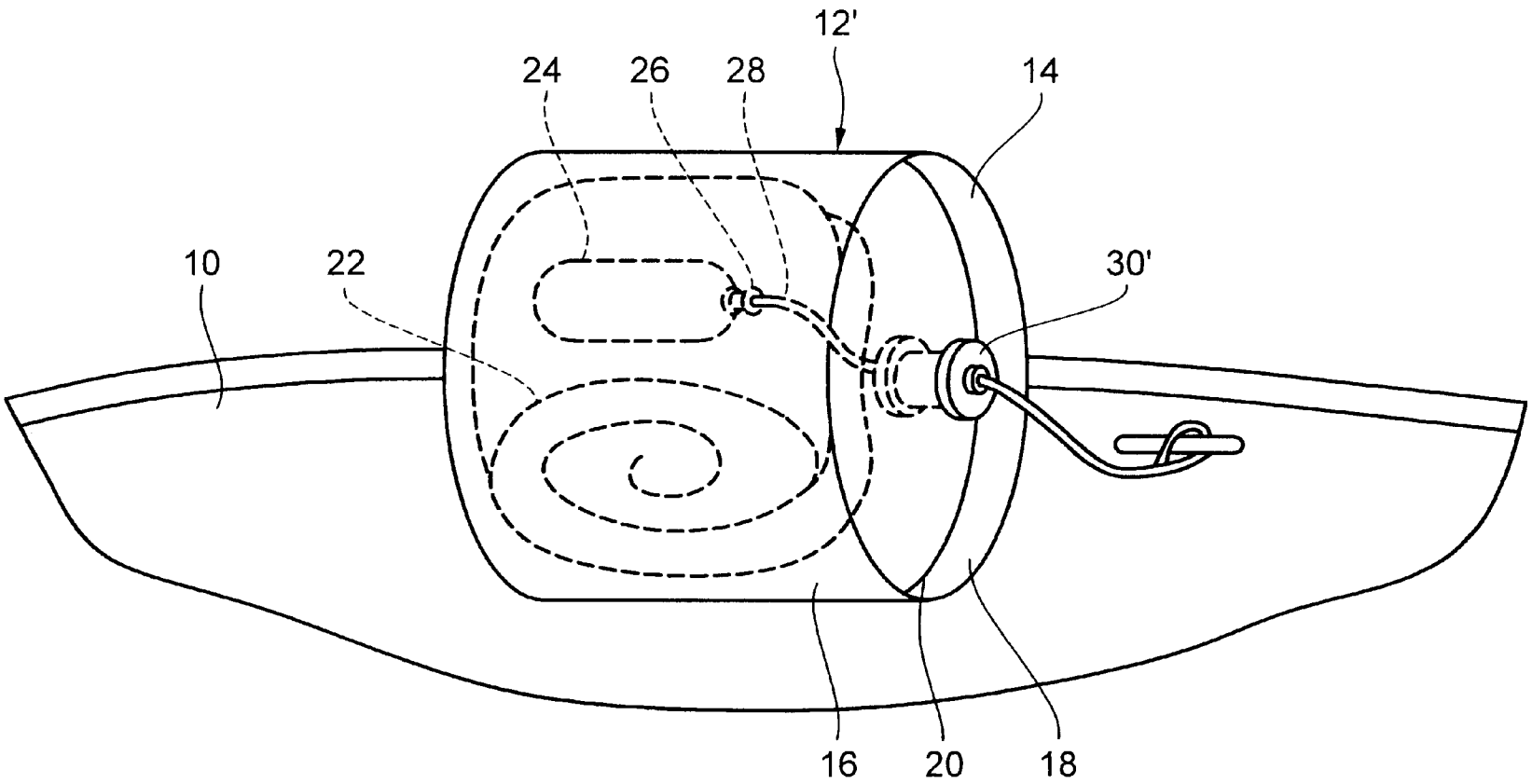
FIG. 2 PRIOR ART
FIG. 2 is a view like that of FIG. 1, but with a bung plug assembly of the prior art.

Looking now at FIGS. 1 and 2, a boat, or ship, 10 has a life-raft assembly 12, 12' mounted thereon including a clamshell canister 14 having a top half 16 and a bottom half 18 joined at an edge interface 20, an inflatable sixteen man life raft 22, a compressed-air cylinder 24 including a valve 26 and a lanyard 28, and a bung-plug assembly 30, 30'.

As can be seen by comparing the drawings of FIGS. 1 and 2, the bung plug assembly 30' of the prior art is located at the edge interface 20 of the top and bottom clamshell halves (half shells) 16 and 18, while the bung plug assembly 30 of this invention is located at a different desired location on the clamshell canister, and the bung plug assembly 30 of this invention has a different structure then does the prior art bung plug assembly 30'. In fact, an advantage of the bung plug assembly of this invention is that it can be mounted at almost any location on a clamshell canister.

Figure 3:
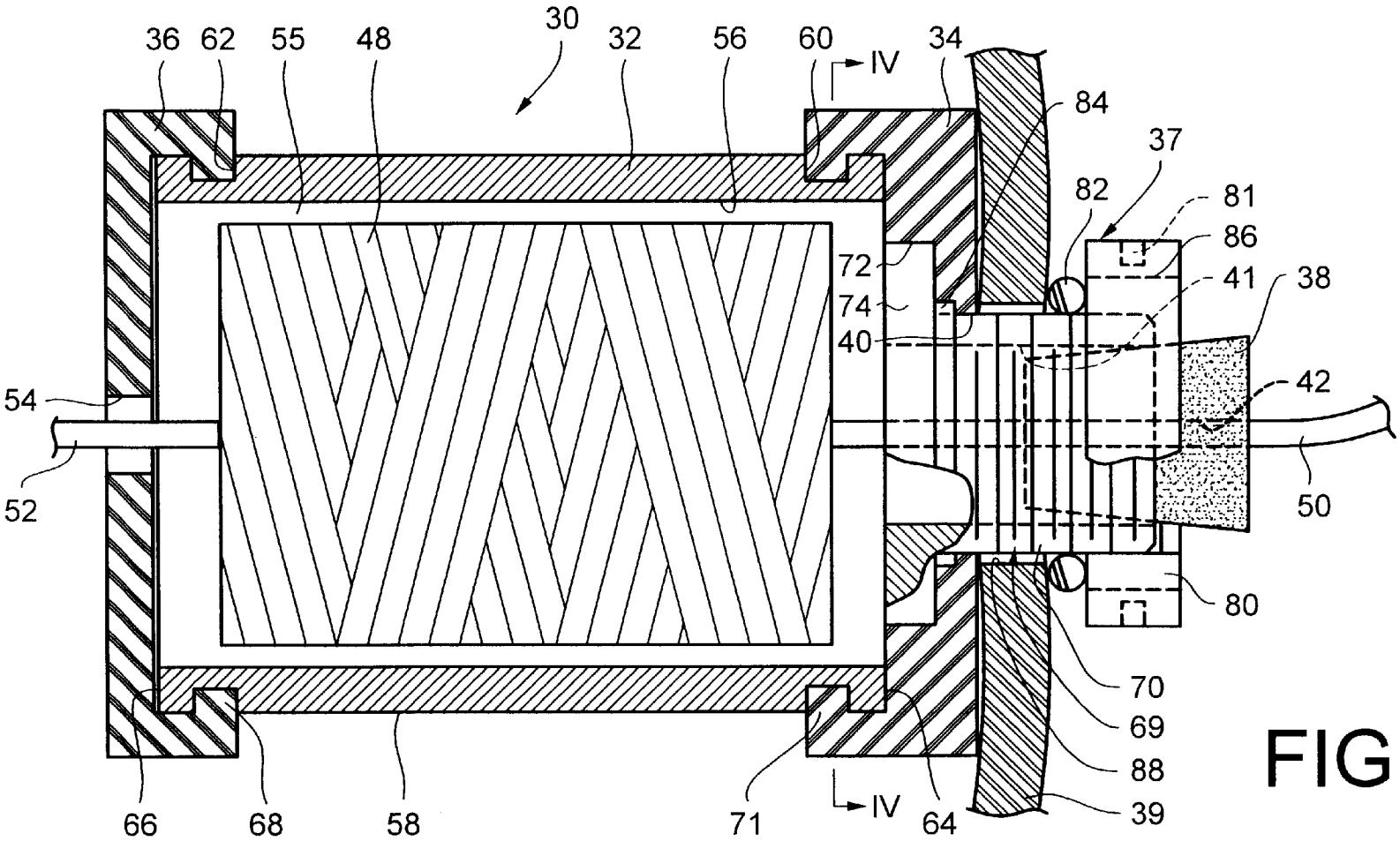
FIG. 3 is a cross-sectional, and further partially cutaway, side view of a bung plug assembly of this invention mounted on a wall of a life-raft canister.
Figure 4:
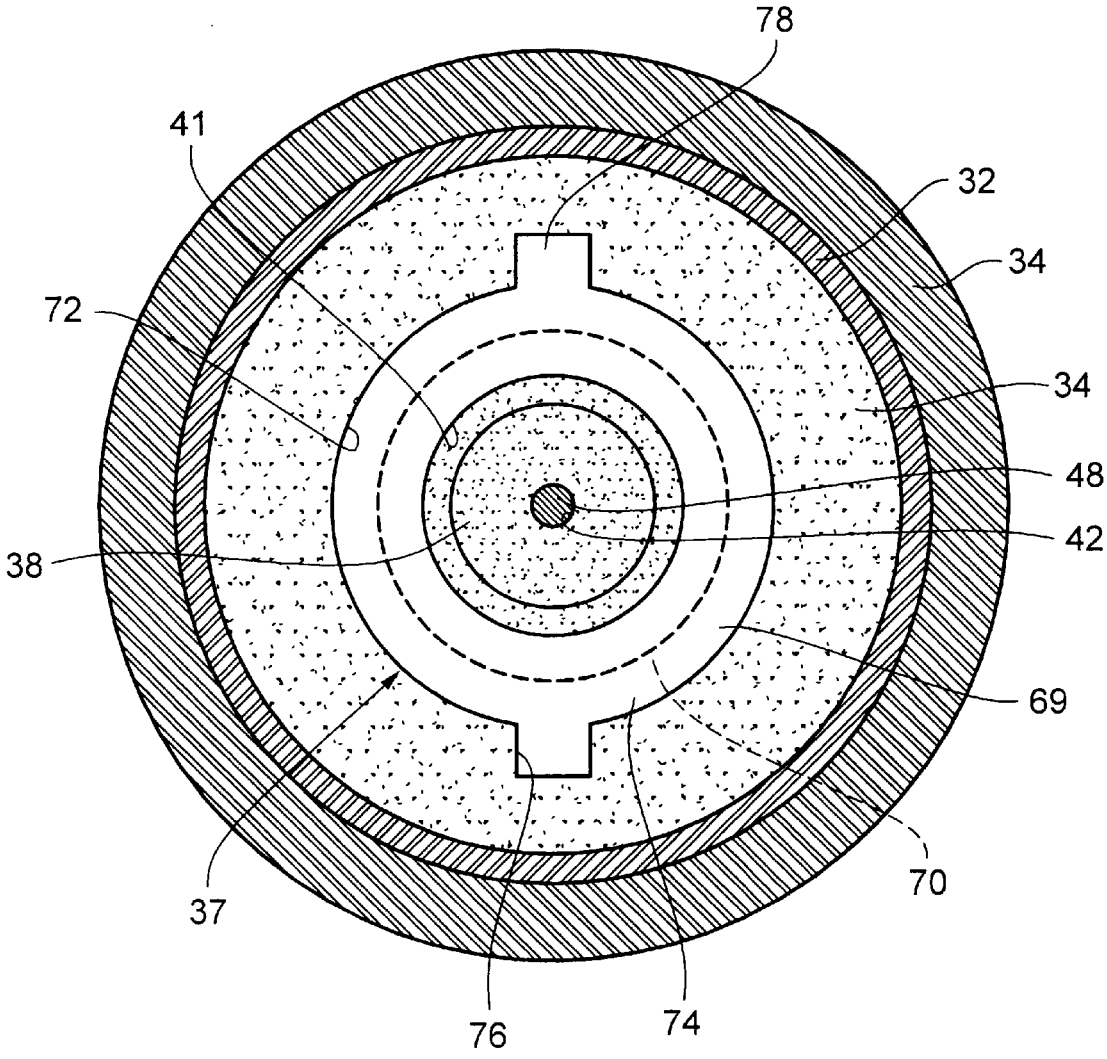
FIG. 4 is a cross-sectional view taken on line IV—IV in FIG. 3.

The bung-plug assembly 30 of this invention is shown in more detail in FIGS. 3 and 4 where it can be seen that the bung-plug assembly includes a painter tube, or tubular housing, 32; a grommet cap 34 mounted at a front, or an outwardly-directed, end of the tubular housing 32 and having a grommet-cap bore 40 therethrough; a rear cap 36 mounted on an inwardly directed end of the tubular housing 32; a bulkhead-adapter assembly 37 for attaching the grommet cap 34 to a canister wall 39; a bung plug 38 tightly insertable into a smooth bulkhead-adapter bore 41 and having a rope passage 42 therethrough; and a coiled rope in the form of a rope winding 48 having an outer-end portion 50 extending through the bulkhead-adapter bore 41 and the bung-plug rope passage 42 and an inner-end portion 52 extending through an rear-cap bore 54.

The tubular housing 32 is constructed of hard PVC resinous plastic to form a tube cavity 55. An inner surface 56 of the tubular housing 32 is completely smooth while an outer surface 58 has annular, outwardly-directed, front and rear slots 60 and 62 therein near front and rear ends 64 and 66.

The rear cap 36 is molded of a resilient, but medium hard, rubber to have the rear-cap bore 54 therethrough and a radially-inwardly directed rear-cap flange 68 for mating with the rear slot 62 of the tubular housing 32 to hold the rear cap 36 on the tubular housing 32, covering a rear-end opening of the tube cavity at the rear end 66.

The grommet cap 34 is also molded of a resilient, medium-hard, rubber to have the grommet-cap bore 40 therethrough for receiving a tube portion 70 of the bulkhead-adapter assembly 37. The grommet cap 34 also defines a radially-inwardly directed grommet flange 71 for mating with the front slot 60 in the tubular housing 32 to hold the grommet cap 34 covering a front-end opening of the tube cavity 55 at the front, or outwardly-directed, end 64 of the tubular housing 32. The grommet cap 34 further defines a bulkhead-adapter-flange cavity 72 for receiving a bulkhead-adapter flange portion 74 of a bulkhead-adapter 69. In this regard, as can be seen in FIG. 4, the bulkhead-adapter-flange cavity 72 has two radial slots 76 for receiving radial tabs 78 on an outer periphery of the bulkhead-adapter flange portion 74.

Looking now at the bulkhead-adapter assembly 37 in more detail, this component includes the bulkhead adapter 69, a separate bulkhead-adapter nut 80 and an O-ring seal 82. The bulkhead adapter 69 is molded of hard plastic, such as PVC, as one piece to include the tube portion 70 and the bulkhead-adapter flange portion 74. As can be seen in FIG. 3, the tube portion 70 is externally threaded (with left-hand threads) and defines the smooth bulkhead-adapter bore 41, which bore also extends through the bulkhead-adapter flange portion 74. The bulkhead-adapter flange portion 74 extends radially outwardly from the outer surface of the tube portion 70. A seal member 84 can be mounted on the tube portion 70 at the interface between the tube portion 70 and the bulkhead-adapter flange portion 74, however, this seal number 84 can also be omitted or molded as one piece with the bulkhead-adapter 69.

The bulkhead-adapter nut 80, which can also be molded of a hard plastic, such as PVC, has internal threads which mate with the external threads of the tube portion 70. Further, there are spanner-wrench recesses on the outer circumference of the bulkhead-adapter nut 80.

The O-ring seal 82 fits on the outer surface of the tube portion 70 and is made of an elastomer such as rubber or a resilient resinous plastic.

The bulkhead-adapter assembly 37 can be constructed as an entirely new item, however, it can also be constructed by modifying existing bulkhead-adapter assemblies. In this regard, bulkhead-adapter assemblies are available, off-the-shelf for tapping containers, tank, and the like. Such off-the-shelf bulkhead-adapter assemblies must usually be modified for this invention by removing internal threads from the bulkhead-adapter bore 41 and by enlarging and making round an outer circumference of the bulkhead-adapter nut 80 by welding, or gluing, a piece of plastic pipe (2 inch, schedule 80, PVC pipe, for example) thereto, as is indicated by a dashed line 86 in FIG. 3. The spanner-wrench recesses 81 are made in this added portion of the bulkhead-adapter nut 80. By increasing the circumference of the bulkhead-adapter nut 80, one is able to apply a greater torque force to the bulkhead-adapter nut 80, and, by making it round, one reduces unauthorized tampering.

The grommet cap 34 and the bulkhead adapter 69 are assembled together as one piece by inserting the tube portion 70 through the central grommet-cap bore 40, as shown in FIG. 3, until the bulkhead-adapter flange portion 74 seats in the bulkhead-adapter-flange cavity 72, with the radial tabs 78 being positioned in the radial slots 76, as can be seen in FIG. 4. In one embodiment, the bulkhead adapter 69 is adhered to the grommet 34 so that they, together, form a composite piece, although this may not be necessary. In one embodiment, this adherence is accomplished by an adhesive, however, it is also possible to mold the grommet cap 34 about the bulkhead-adapter assembly 37.

Describing now operation of the bung-plug assembly 30 of this invention, the bung-plug assembly 30 is assembled by placing the rope winding 48 in the tube cavity 55 and closing the rear end 66 of the tubular housing 32 with the rear cap 36 and closing the front end 64 with the composite piece formed by the grommet cap 34 and the bulkhead adapter 69, with the inner-end portion 52 of the rope extending through the rear-cap bore 54 and the outer-end portion 50 of the rope extending through the bulkhead-adapter bore 41 and the rope passage 42 of the bung plug 38. The bung plug 38 is tightly contracted onto the outer-end portion 50 of the rope and is inserted tightly in the outer end of the bulkhead-adapter bore 41.

Figure 5:
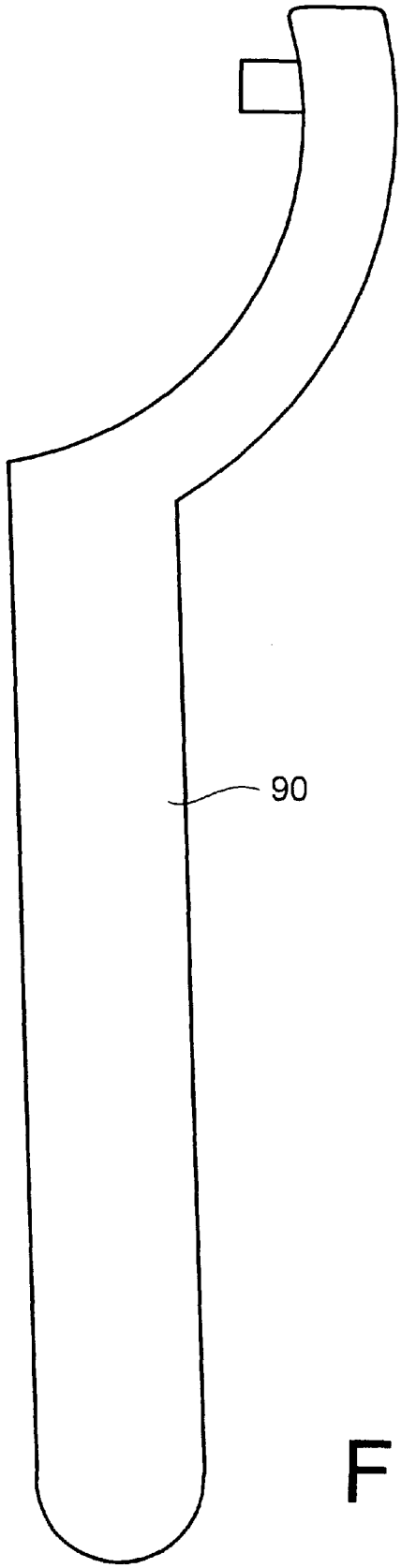
FIG. 5 is a side view of a spanner tool used for mounting the bung plug assembly of this invention.

The next step is to mount the bung-plug assembly 30 on a clamshell canister 14, as is depicted in FIG. 1. First, one decides the most appropriate place on the clamshell canister for mounting the bung-plug assembly 30 in order to accommodate the life raft 22 in the clamshell canister and to achieve the life raft's best deployment therefrom. A canister-wall opening 88 is bored in the canister wall 39 of a half shell at the point chosen for locating the bung-plug assembly 30 and the tube portion 70 is inserted through the canister-wall opening 88 from inside the canister half shell. The O-ring seal 82 and the bulkhead-adapter nut 80 are then applied to the tube portion 70, with internal threads of the bulkhead-adapter nut 80 being screwed onto the external threads of the tube portion 70. A spanner wrench, for example wrench 90 of FIG. 5, is engaged in one or more of the spanner wrench recesses 81 and used to tighten the bulkhead-adapter nut 80 for thereby clamping the canister wall 39 between the grommet 34 and the bulkhead-adapter nut 80. Of course, the O-ring seal 80 is also therebetween to provide a sealing of the canister-wall opening 88.

This half shell is then used to form the life-raft assembly 12 depicted in FIG. 1 which is mounted on the boat 10. Otherwise, the life-raft assembly 12 functions as does the prior-art life-raft assembly 12', and reference is made to U.S. Pat. No. 5,154,653 for its description thereof as well as for any other disclosures helpful in understanding this invention.

It will be understood by those of ordinary skill in the art that the bulkhead-adapter assembly 37 of this invention can be mounted at almost any position on a clamshell canister so that accommodation of a life raft in, and deployment of the life raft from, the clamshell canister can be optimized.

Further, the bulkhead-adapter assembly 37 of this invention can be mounted to a half shell prior to the half shells of the clamshell canister being closed so that the bulkhead-adapter assembly does not complicate such closing.

Yet another benefit of this invention is that the rope slides on the smooth hard surface defining the bulkhead-adapter bore 41, unlike in the device of U.S. Pat. No. 5,154,651 where the rope slid on a resilient grommet cap.

Still another benefit of this invention is that, because a circumferentially outer surface of the bulkhead-adapter nut 80 is circular, it is difficult for one to rotate it by hand, however, the spanner wrench recesses allow one to rotate it with the spanner wrench of FIG. 5. By requiring a special tool for rotating the bulkhead-adapter nut 80, tampering by unauthorized persons is reduced.

While the invention has been particularly shown and described with reference to a preferred embodiment, it will be understood by those skilled in the art that various changes in form and detail may be made therein without departing from the spirit ad scope of the invention.

The invention claimed is:

1. A bung-plug assembly for allowing an outer-end portion of coiled rope to extend through a hole in a life raft canister while allowing payout of said coiled rope through said hole when an outside end, which is outside said life raft canister, has a significant force applied thereto relative to said life raft canister and for supporting said coiled rope inside said life raft canister so as to allow said payout upon application of said significant force, said bung-plug assembly comprising:

a tubularly-shaped housing for holding said coiled rope in a housing cavity;

an engaging device mounted at an outwardly directed end of said tubularly-shaped housing for engaging said tubularly-shaped housing to said canister at said hole and thereby at least partially supporting said bung-plug assembly from said canister;

wherein said engaging device comprises:

a grommet cap having a grommet-cap bore therethrough, said grommet cap being attached to said tubularly-shaped housing;

a bulkhead adapter including a tube portion having male threads therealong at an outer end and a radially-outwardly extending flange portion at an inner end, said tube portion extending through the grommet bore with the flange portion abutting on a surface of the grommet cap facing the housing cavity;

a separate bulkhead-adapter nut having female threads for engaging the male threads at the outer end of said tube portion;

said bung-plug assembly being mountable on said life-raft canister by extending said tube portion of said bulkhead adapter through an opening in a wall of life-raft canister and screwing said bulkhead-adapter nut onto said tube portion for clamping said wall of said life-raft canister between said bulkhead-adapter nut and said grommet cap.

2. The bung-plug assembly of claim 1 wherein said bulkhead adapter has a bulkhead-adapter bore therethrough and wherein an outer end of said coiled rope extends through the bulkhead-adapter bore.

3. The bung-plug assembly of claim 2 wherein is further included a bung plug having a rope passage therethrough for tightly receiving said outer end of said coiled rope and for tightly engaging a surface defining said bulkhead-adapter bore.

4. The bung-plug assembly of claim 3 wherein is further included a resilient rear cap for covering an inwardly directed end of said tubularly-shaped housing having a rear-cap bore therethrough for allowing passage of an inner-end portion of said rope.

5. The bung-plug assembly of claim 4 wherein the bulkhead-adapter bore has a smooth surface.

6. The bung-plug assembly of claim 2 wherein the bulkhead-adapter bore has a smooth surface.

7. The bung-plug assembly of claim 2 wherein said flange portion is adhered to the grommet cap.

8. The bung-plug assembly of claim 7 wherein said flange portion is circular with radial tabs.

9. The bung-plug assembly of claim 1 wherein said flange portion is adhered to the grommet cap.

10. The bung-plug assembly of claim 9 wherein said flange portion is circular with radial tabs.

11. The bung-plug assembly of claim 1 wherein the bulkhead-adapter nut has a circular outer surface.

12. The bung-plug assembly of claim 1 wherein there are recesses in said circular outer surface for receiving a spanner wrench.

* * * * *